US006651639B2

(12) United States Patent
Hada et al.

(10) Patent No.: US 6,651,639 B2
(45) Date of Patent: Nov. 25, 2003

(54) HEATER CONTROL APPARATUS FOR A GAS CONCENTRATION SENSOR

(75) Inventors: Satoshi Hada, Kariya (JP); Eiichi Kurokawa, Okazaki (JP); Toshiyuki Suzuki, Handa (JP)

(73) Assignee: Denso Corporation, Kariya (JP)

( * ) Notice: Subject to any disclaimer, the term of this patent is extended or adjusted under 35 U.S.C. 154(b) by 29 days.

(21) Appl. No.: 10/026,801

(22) Filed: Dec. 27, 2001

(65) Prior Publication Data

US 2002/0078938 A1 Jun. 27, 2002

(30) Foreign Application Priority Data

Dec. 27, 2000 (JP) ..... 2000-397308
Nov. 5, 2001 (JP) ..... 2001-338975

(51) Int. Cl.[7] ..... F02D 41/00
(52) U.S. Cl. ..... 123/697; 73/23.32
(58) Field of Search ..... 123/697, 703, 123/672, 693, 694, 695, 696; 73/23.32, 23.33, 118.1

(56) References Cited

U.S. PATENT DOCUMENTS 4,538,575 A 9/1985 Chujo et al.
4,561,402 A * 12/1985 Nakano et al. ..... 73/23.32
4,694,809 A * 9/1987 Nakano et al. ..... 123/684
5,852,228 A 12/1998 Yamashita et al.
5,974,857 A * 11/1999 Yamashita et al. ..... 73/23.32
6,009,866 A * 1/2000 Sagisaka et al. ..... 123/681
6,258,232 B1 7/2001 Hasegawa et al.
6,304,813 B1 * 10/2001 Ikeda et al. ..... 701/109
6,341,599 B1 * 1/2002 Hada et al. ..... 123/688

FOREIGN PATENT DOCUMENTS

JP 59-190651 10/1984
JP 9-166575 6/1997
JP 10-300716 11/1998
JP 11-183431 7/1999
JP 11-183432 7/1999

* cited by examiner

*Primary Examiner*—Mahmoud Gimie
(74) *Attorney, Agent, or Firm*—Nixon & Vanderhye P.C.

(57) ABSTRACT

An air-fuel ratio sensor is equipped with a sensing element including a solid electrolytic substrate. When the sending element is warmed up and activated by a heater, a microcomputer controls electric power supplied to the heater based on a control base value being set according to a duty ratio=100%. A power profile P1 is determined beforehand to set a target heater power. Through the warm-up heater power control, an actual heater power supplied to the heater is equalized to the target heater power determined according to the power profile P1.

16 Claims, 11 Drawing Sheets

HEATER CONTROL APPARATUS FOR A GAS CONCENTRATION SENSOR

BACKGROUND OF THE INVENTION

The present invention relates to a heater control apparatus for a gas concentration sensor.

In an automotive engine, an air-fuel ratio is controlled based on a detection value of a gas concentration sensor. In general, a gas concentration sensor is equipped with a sensing element including a zirconia solid electrolytic substrate. To assure accurate detection of air-fuel ratio (i.e., oxygen concentration) based on the sensing element, it is necessary to maintain the temperature of this sensing element in a predetermined active temperature zone. To this end, a heater is installed in the sensor body. The electric power supplied to this heater is controlled based on a duty ratio.

According to this type of gas concentration sensor, speedily warming up the sensing element is very important to assure accurate operation of the sensor especially when the engine is in a cold start-up condition. However, increasing the temperature so quickly may cause the cracking of sensing element or heater body and also cause the peeling of substrates constituting the sensor.

SUMMARY OF THE INVENTION

In view of the above-described problems, the present invention has an object to provide a heater control apparatus for a gas concentration sensor which is capable of assuring adequate warm-up performance free from the cracking of sensor element or heater body and related problems.

In order to accomplish the above and other related objects, the present invention provides a heater control apparatus for a gas concentration sensor, comprising a sensing element including a solid electrolytic substrate and a heater for heating and activating the sensing element. The heater control apparatus of this invention comprises a warm-up heater control means for controlling electric power supplied to the heater based on a control base value being set according to a predetermined duty ratio, when the sensing element is warmed up to an active temperature. A power profile is determined beforehand to set a target heater power. The warm-up heater control means controls the electric power supplied to the heater so as to equalize an actual heater power to the target heater power determined according to the power profile.

More specifically, to quickly activate the sensing element, the control base value is set to a predetermined value (e.g., duty ratio=100%) to promptly supply electric power to the heater. However, to suppress excessive electric power supply to the heater and adopts, the present invention adopts a power profile defining or expressing an ideal transitional change of target heater power, thereby surely eliminating the cracking of sensor element and heater body.

According to a preferred embodiment of the present invention, the warm-up heater control means performs a correction applied to the control base value based on a relationship between a momentary heater power and the target heater power, and controls the electric power supplied to the heater based on a corrected duty ratio.

It is also preferable that the warm-up heater control means performs a feedback control operation based on a deviation of momentary heater power from the target heater power.

It is also preferable that the power profile is converted into map data, and the warm-up heater control means controls the electric power supplied to the heater based on an elapse of time or a cumulative power with reference to map data during a heater control operation.

It is also preferable that the warm-up heater control means corrects the target heater power so as to eliminate a deviation in a relationship between an elapse of time and a cumulative power or eliminate a deviation in a relationship between the target heater power and a momentary heater power.

It is also preferable that the warm-up heater control means limits the electric power supplied to the heater so as to prevent the actual heater power from exceeding the target heater power.

It is also preferable that the power profile is determined under a condition that the duty ratio of the control base value is set to 100%.

It is also preferable that the power profile is determined under a condition that a stationary reference voltage is applied to the heater.

It is also preferable that the power profile is determined under a condition that a stationary reference voltage is applied to the heater, and the warm-up heater control means performs a correction applied to the control base value based on a relationship between a momentary heater voltage and the stationary reference voltage, and controls the electric power supplied to the heater based on a corrected duty ratio. For example, the correction of the warm-up heater control means is performed according to a ratio of the stationary reference voltage to the momentary heater voltage.

The present invention brings the same effects even if the power profile is replaced by an equivalent or comparable profile.

For example, instead of using the power profile, a current profile is adopted beforehand to set a target heater current. The warm-up heater control means controls the electric power supplied to the heater so as to equalize an actual heater current to the target heater current determined according to the current profile. The warm-up performance is adequately maintained. The cracking of sensing element or heater body can be surely prevented.

It is also preferable that the gas concentration sensor is for detecting the concentration of an exhaust gas component emitted from an engine installed in an automotive vehicle. The heater control apparatus receives electric power supplied from a battery mounted on the automotive vehicle. The warm-up heater control means sets a guard value corresponding to a voltage change of the battery to limit the duty ratio of the control base value. This effectively suppresses the excessive power supply to the heater.

It is also preferable that the warm-up heater control means calculates an initial resistance value of the heater and sets a warm-up control time corresponding to the initial resistance value, for performing a warm-up heater control operation during a limited period of time defined by the warm-up control time. For example, when the heater resistance is small, there is a higher possibility that the sensing element may cause a crack. Thus, the warm-up control time is set to a relatively small value.

On the other hand, it is also preferable that the warm-up heater control means enlarges the warm-up control time when an actual voltage applied to the heater is lower than the reference voltage.

It is also preferable that the warm-up heater control means performs a warm-up operation during a limited period of time before starting an ordinary heater power control operation based on a sensing element resistance or a heater resistance.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
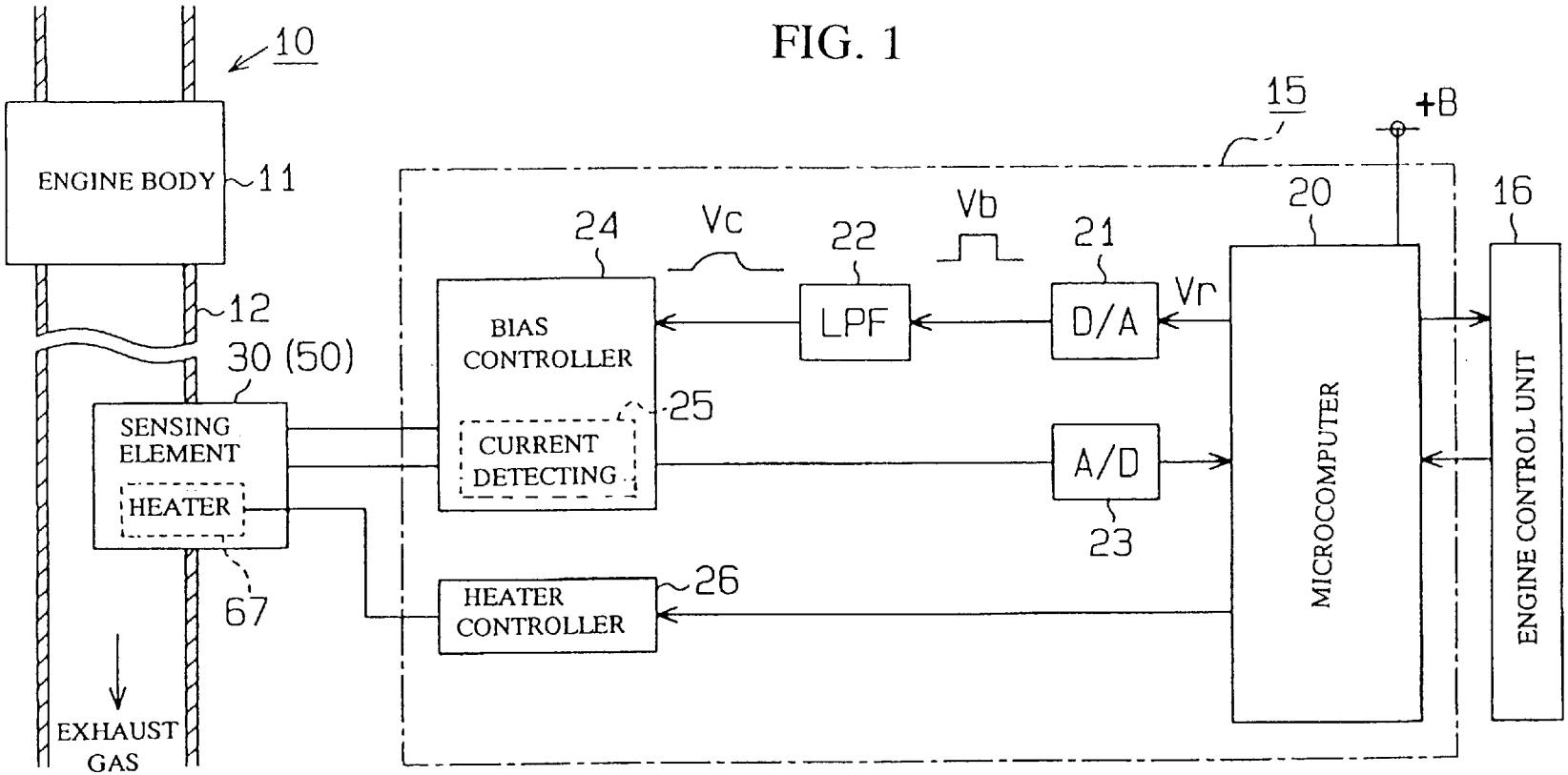
FIG. 1 is a circuit diagram showing a schematic arrangement of an air-fuel ratio detecting apparatus in accordance with a preferred embodiment of the present invention.

A preferred embodiment of the present invention will be explained hereinafter with reference to attached drawings. Identical parts are denoted by the same reference numerals throughout the drawings.

The preferred embodiment of this invention relates to an air-fuel ratio detecting apparatus incorporated in a fuel injection control system for an internal combustion engine (i.e., gasoline engine) installed in an automotive vehicle. The fuel injection control system adjusts the amount of fuel introduced or charged into a combustion chamber of the engine based on a sensing result obtained by the air-fuel ratio detecting apparatus so as to optimize the air-fuel ratio to a target value during the combustion of fuel. Furthermore, a limiting current type air-fuel ratio sensor (hereinafter, referred to as A/F sensor) is used to detect an oxygen concentration in the exhaust gas. To maintain the A/F sensor in an activated condition, an element impedance of the sensor is detected and the electric power supplied to a built-in heater of this sensor is controlled.

FIG. 1 is a circuit diagram showing a schematic arrangement of an air-fuel ratio detecting apparatus in accordance with a preferred embodiment of the present invention.

An air-fuel ratio detecting apparatus 15 comprises a microcomputer 20. The microcomputer 20 is connected to an engine control unit (i.e., ECU) 16 to perform interactive data communications for a fuel injection control, an ignition control and the like.

An A/F sensor 30 is installed in an exhaust pipe 12 extending from an engine body 11 of an engine 10. The A/F sensor 30 is responsive to a command voltage supplied from the microcomputer 20 and generates an air-fuel ratio sensing signal (i.e., sensor current signal) which is linear and proportional to the oxygen concentration in the exhaust gas.

The microcomputer 20, consisting of well-known components such as CPU, ROM, RAM for performing various computational processing, controls a bias controller 24 and a heater controller 26 according to a predetermined control program. The microcomputer 20 is connected to a battery +B and receives electric power for operation.

Figure 2:
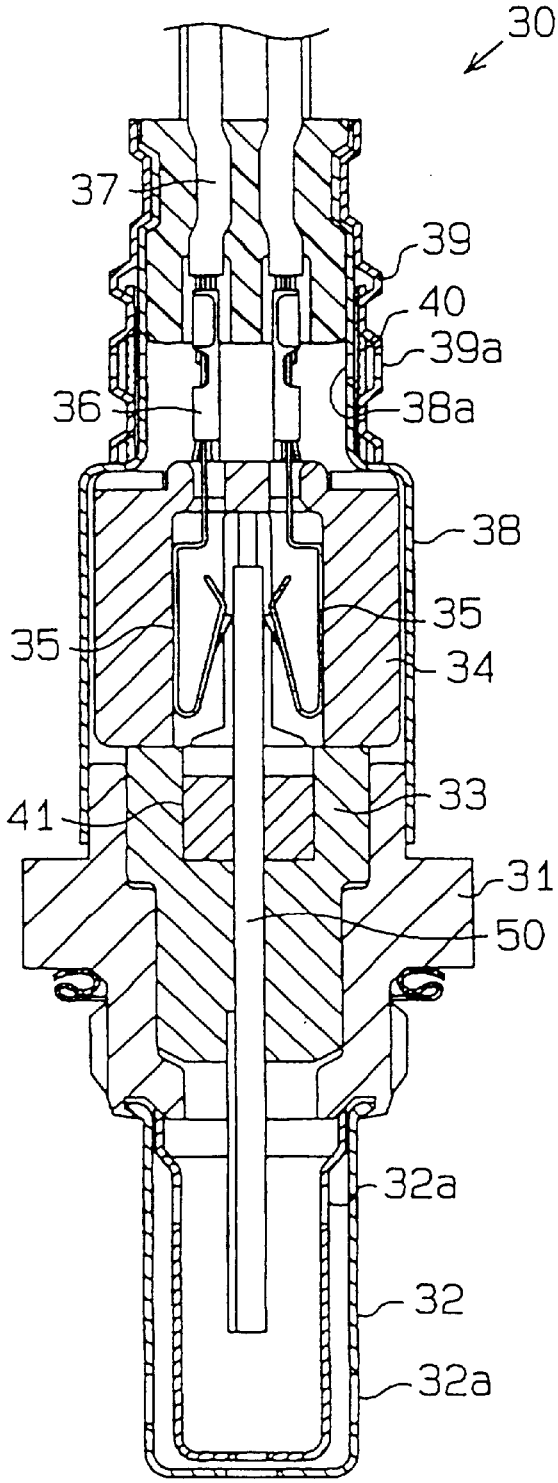
FIG. 2 is a vertical cross-sectional view showing an overall arrangement of an air-fuel ratio sensor in accordance with the preferred embodiment of the present invention.

FIG. 2 is a vertical cross-sectional view showing an overall arrangement of A/F sensor 30. As shown in FIG. 2, A/F sensor 30 comprises a cylindrical metal housing 31 with a threaded outer portion securely fixed to a wall of exhaust pipe 12. The lower part of the housing 31 protrudes from the wall of exhaust pipe 12 and is exposed to the exhaust gas flowing in the exhaust pipe 12. A double element cover 32, consisting of inner and outer cup-shaped covers, is attached to a lower opening end of the housing 31. A multilayered sensing element 50, configured into an elongated plate shape, extends in the axial direction of housing 31 so that the lower end of the sensing element 50 is placed in the inside space of the element cover 32. The element cover 32 is provided with a plurality of holes 32*a* which introduce the exhaust gas into the inside space of the element cover 32 for forming an exhaust gas atmosphere surrounding the lower end of the sensing element 50.

An insulating member 33, intervening between the sensing element 50 and the inside wall of the housing 31, supports the sensing element 50. A glass sealing member 41, located in a bore formed at an upper portion of the insulating member 33, airtightly seals the clearance between the sensing element 50 and the insulating member 33. Another insulating member 34, provided on the insulating member 33, has an inside space in which the sensing element 50 is connected to four leads 35. Two of leads 35 are connected to electrodes of the sensing element 50 to output a sensing signal, while the remaining two leads 35 are used for supplying electric power to a heater of the sensing element 50. These leads 35 are connected to external signal lines 37 via connectors 36.

A body cover 38 is welded to the upper end of the housing 31. A dust cover 39 is attached to the upper end of body cover 38. These covers 37 and 38 cooperatively protect the upper portion of the sensor. A water repellent filter 40 is interposed between these covers 37 and 38 at an overlapped portion thereof. The covers 37 and 38 are provided with a plurality of holes 38*a* and 39*a* which introduce the air into the inside space of the covers 37 and 38.

Figure 3:
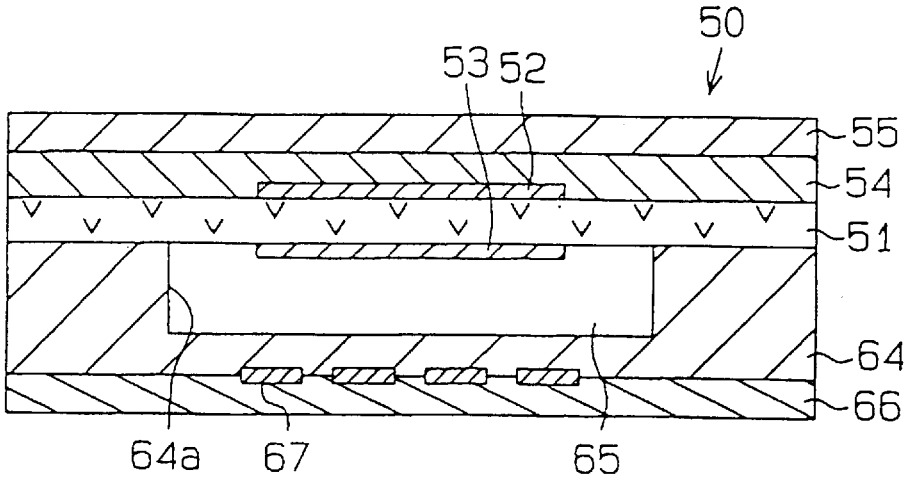
FIG. 3 is a cross-sectional view showing an essential arrangement of a sensing element in accordance with the preferred embodiment of the present invention.

As shown in FIG. 3, the sensing element 50 comprises a solid electrolytic substrate 51 which is a partially-stabilized zirconia member having oxygen ion conductivity and configured into a platelike shape. An exhaust gas side electrode 52 is provided on one surface of the solid electrolytic substrate 51. A reference gas side electrode 53 is provided on the opposite surface of the solid electrolytic substrate 51 so as to be exposed to a reference gas stored in a reference gas chamber 65. A porous diffusion resistive layer 54, made of an alumina ceramic member having a porosity of approximately 10%, is stacked or laminated on the upper surface of the solid electrolytic substrate 51 so as to entirely cover the exhaust gas side electrode 52. A gas shielding layer 55, made of an alumina ceramic member having gas-shielding properties, is stacked or laminated on the porous diffusion resistive layer 54.

A spacer 64, made of an alumina ceramic having electric insulating and gas-impermeable alumina ceramic, is stacked on the opposite (lower) surface of the solid electrolytic substrate 51. The spacer 64 has a groove 64*a* defining the reference gas chamber 65. A heater substrate 66 is stacked or laminated beneath the spacer 64 so as to embed a heater (i.e., heat generating element) 67 therebetween. The heater 67 generates heat in response to supplied electric power to warm up the substrates and electrodes of the sensing element 50.

Returning to FIG. 1, the microcomputer 20 produces a bias command signal Vr for applying a voltage to A/F sensor 30 (i.e., to sensing element 50). A digital-to-analog (D/A) converter 21 receives the bias command signal Vr produced as a digital signal from the microcomputer 20, and converts it into an analog signal Vb. A low-pass filter (LPF) 22 receives the analog signal Vb produced from D/A converter 21, and removes high-frequency components from the analog signal Vb to produce an LPF output Vc sent to the bias controller 24. The bias controller 24 produces a voltage corresponding to a momentary air-fuel ratio with reference to predetermined application voltage characteristics, and applies the produced voltage to A/F sensor 30 during an A/F detecting operation. Furthermore, the bias controller 24 produces a voltage as a predetermined frequency signal applied to A/F sensor 30 in a one-shot manner with a predetermined time constant during an element impedance detecting operation.

The bias controller 24 includes a current detecting circuit 25 which detects a current value flowing across the A/F sensor 30 in response to the applied voltage. An analog-to-digital (A/D) converter 23 receives an analog signal representing the current value detected by the current detecting circuit 25, and converts it into a digital signal. The digital output signal of A/D converter 23 is sent to the microcomputer 20. The heater controller 26 controls the operation of heater 67 provided in the sensing element 50. More specifically, the heater controller 26 performs a duty control operation of electric power supplied to the heater 67 based on the element impedance of A/F sensor 30.

Figure 4:
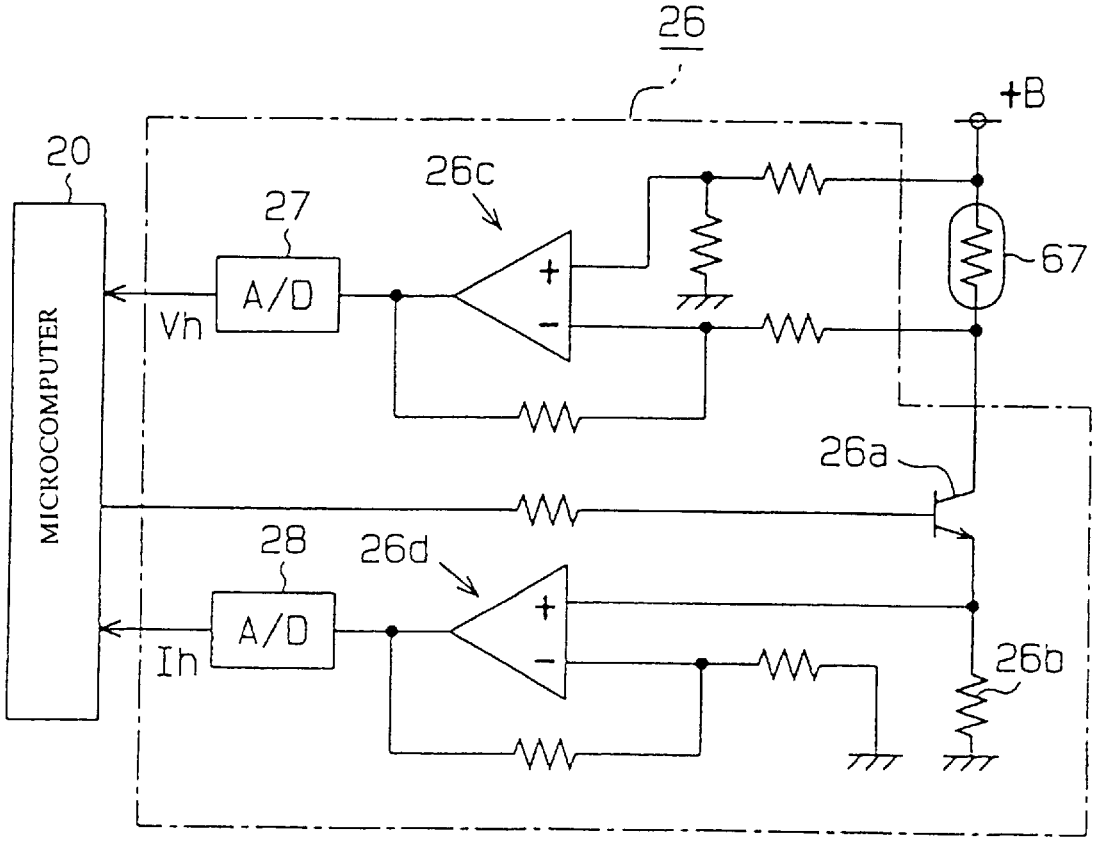
FIG. 4 is a circuit diagram showing the details of a heater controller of the air-fuel ratio detecting apparatus in accordance with the preferred embodiment of the present invention.

FIG. 4 shows a circuit arrangement of the heater controller 26. The heater 67 has one end connected to the battery +B and the other end connected to a collector of transistor 26*a*. An emitter of transistor 26*a* is grounded via a heater current detecting resistor 26*b*. The heater controller 26 detects a heater voltage Vh as a potential (voltage) difference between terminals of the heater 67. The detected heater voltage Vh is sent to the microcomputer 20 via an operational amplifier 26*c* and an A/D converter 27. The heater controller 26 detects a heater current Ih based on a potential (voltage) difference between terminals of the heater current detecting resistor 26*b*. The detected heater current Ih is sent to the microcomputer 20 via an operational amplifier 26*d* and an A/D converter 28.

The air-fuel ratio detecting apparatus 15 operates in the following manner.

Figure 5:
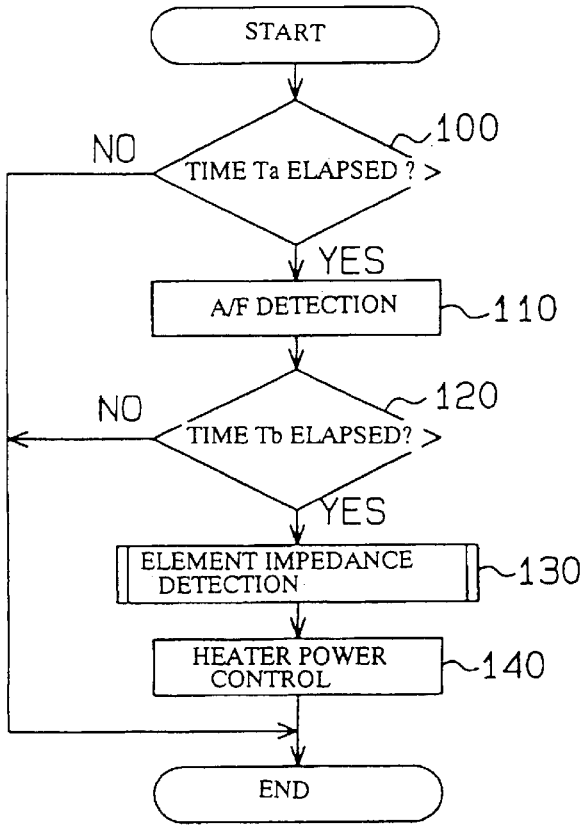
FIG. 5 is a flowchart showing a main routine of the control operation performed in a microcomputer in accordance with the preferred embodiment of the present invention.

FIG. 5 is a flowchart showing a main routine of the control operation performed in the microcomputer 20. The main routine is activated in response to the supply of electric power to the microcomputer 20.

In step 100, it is checked whether or not a predetermined time Ta has elapsed since the previous A/F detecting operation. The predetermined time Ta corresponds to a cycle (i.e., period of time) of the A/F detecting operation. For example, a practical value of Ta is 4 msec.

When the time Ta has already elapsed (i.e., YES in step 100), the control flow proceeds to step 110 to execute the A/F detecting operation. In the A/F detecting operation, an application voltage is determined in accordance with the momentary sensor current and applied to the sensing element 50 of A/F sensor 30. The current detecting circuit 25 detects the sensor current flowing across the sensing element 50 in response to the applied voltage. The detected sensor current is converted into an A/F value.

Next, in step 120, it is checked whether or not a predetermined time Th has elapsed since the previous element impedance detecting operation. The predetermined time Th corresponds to a cycle (i.e., period of time) of the element impedance detecting operation. For example, a practical value of Th is variable from 128 msec to 2 sec in accordance with engine operating conditions.

When the time Th has already elapsed (i.e., YES in step 120), the control flow proceeds to step 130 to execute the element impedance detecting operation and then proceeds to step 140 to execute the heater power control operation. Details of the element impedance detecting operation and the heater power control operation will be explained later.

Figure 6:
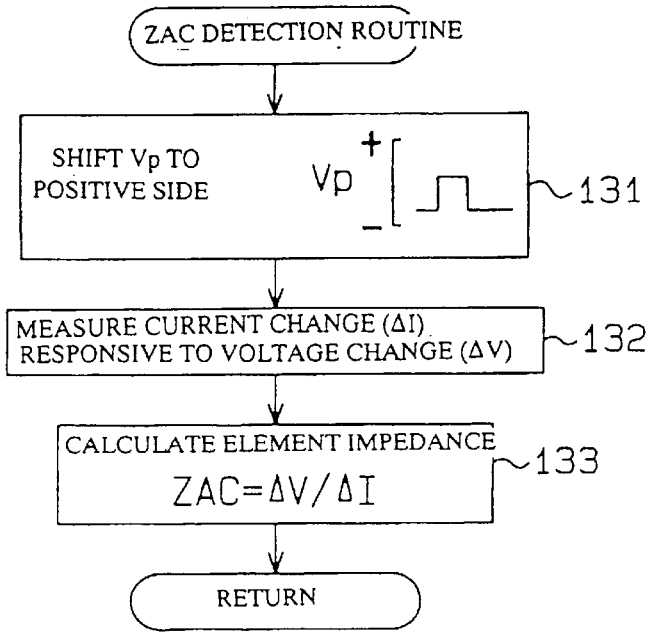
FIG. 6 is a flowchart showing an element impedance detecting routine used in the microcomputer in accordance with the preferred embodiment of the present invention.

FIG. 6 is a flowchart showing the details of the element impedance (ZAC) detecting operation performed in step 130. According to this embodiment, the element impedance ZAC is detected as "alternating current impedance" based on a sweep method.

In step 131 of FIG. 6, the voltage applied for the A/F detection is changed to a positive side for a short period of several 10 to 100 $\mu$sec by adjusting the bias command signal Vr.

Then, in step 132, the current detecting circuit 25 measures a current change ($\Delta$I) responsive to a voltage change ($\Delta$V).

In the next step 133, the element impedance ZAC (=ΔV/ΔI) is calculated based on the measured current change (ΔI) and the voltage change (ΔV).

After completing step 133, the control flow returns to step 140 of FIG. 5.

Figure 8:
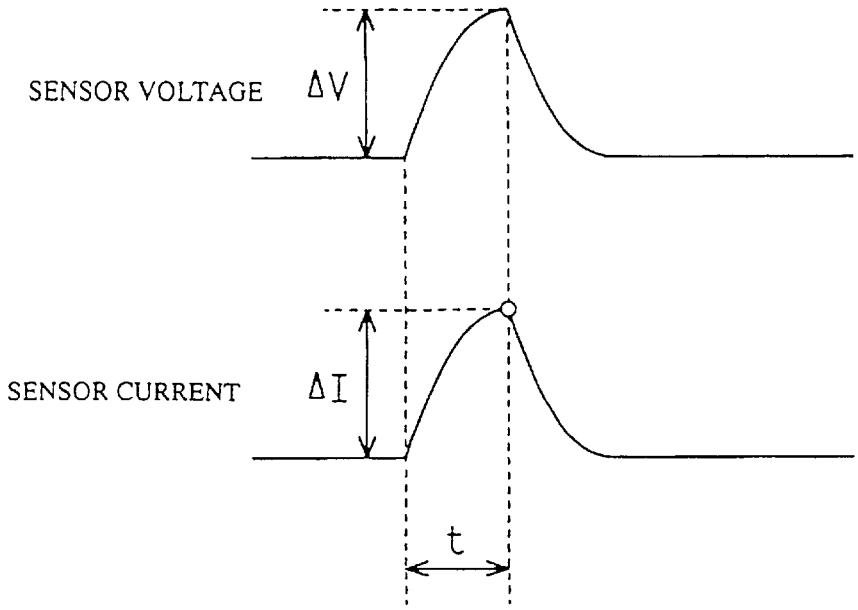
FIG. 8 is a timing chart showing a sensor voltage change and a sensor current change during the detection of an element impedance.

According to the above-described processing, a one-shot voltage having a predetermined time constant is applied to the A/F sensor 30 through LPF 22 and the bias control circuit 24 shown in FIG. 1. As a result, as shown in FIG. 8, the sensor current changes in response to the applied voltage and a peak current ΔI appears after elapse of a predetermined time 't'. The element impedance ZAC is obtained as a ratio of the voltage change (ΔV) to the current change (ΔI) measured in this transient state.

Figure 9:
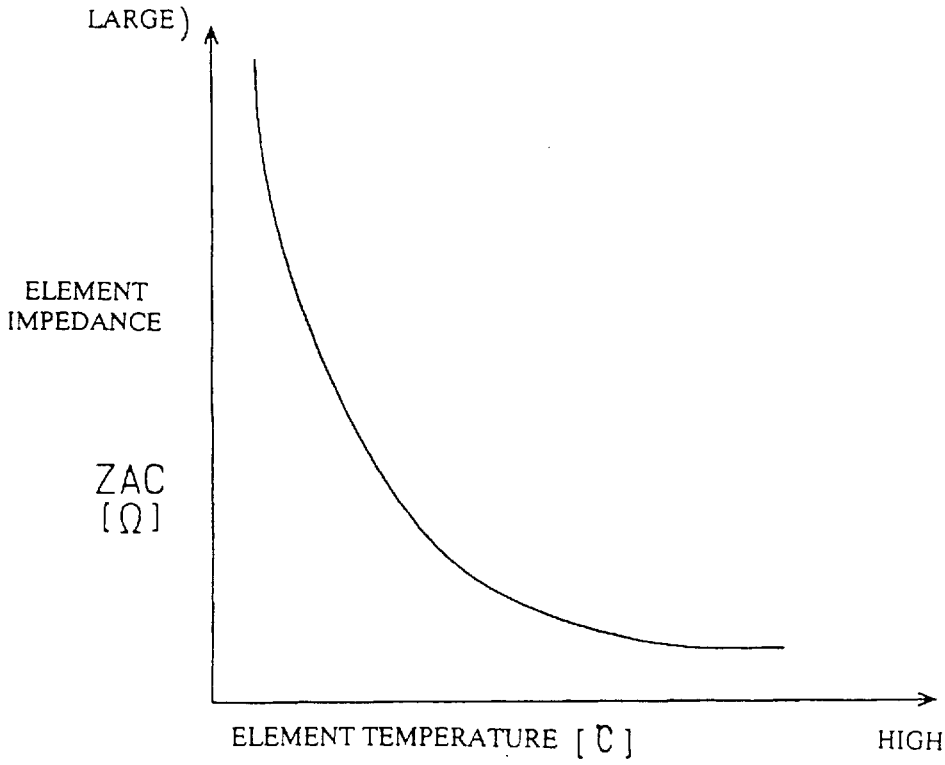
FIG. 9 is a graph showing a relationship between the element impedance and the element temperature.

Interposing LPF 22 for applying the one-shot voltage to the A/F sensor 30 is effective to prevent the peak current from excessively increasing or overshooting. This realizes reliable detection for the element impedance ZAC. As shown in FIG. 9, the element impedance ZAC greatly increases with reducing element temperature.

The present invention improves the warm-up performance of the sensing element 50 and prevents the cracking of sensing element 50. To this end, this embodiment controls the heater power supply (i.e., electric power supplied to heater 67) according to a predetermined power profile in the following manner.

Figure 10A:
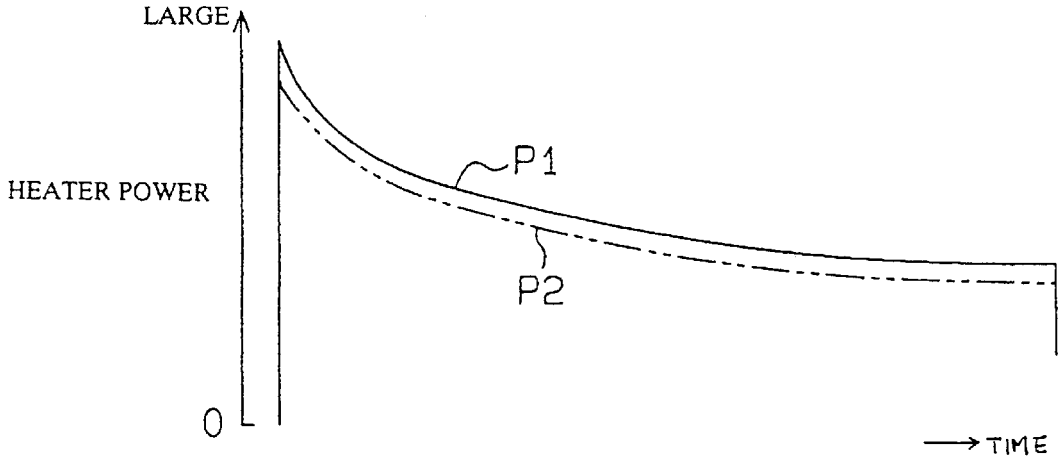
FIG. 10A is a timing chart showing a heater power profile used in the heater power control in accordance with the preferred embodiment of the present invention.
Figure 10B:
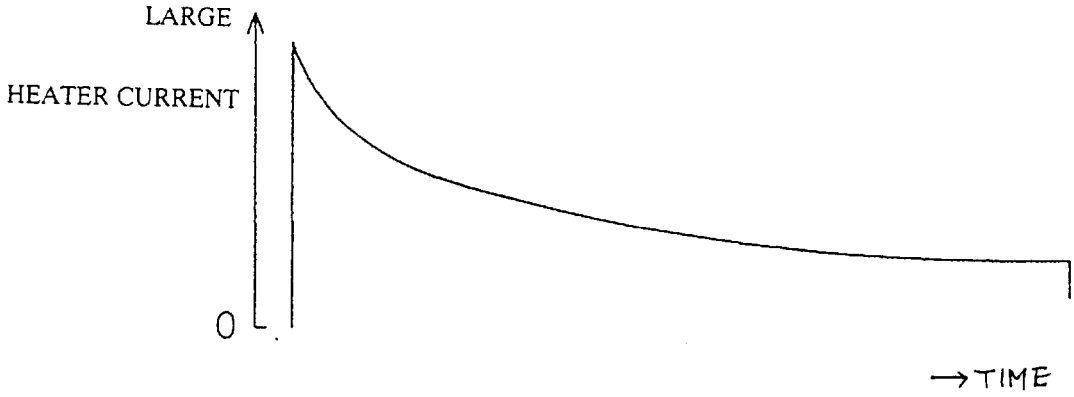
FIG. 10B is a time chart showing the change of heater current during the heater power control in accordance with the preferred embodiment of the present invention.
Figure 10C:
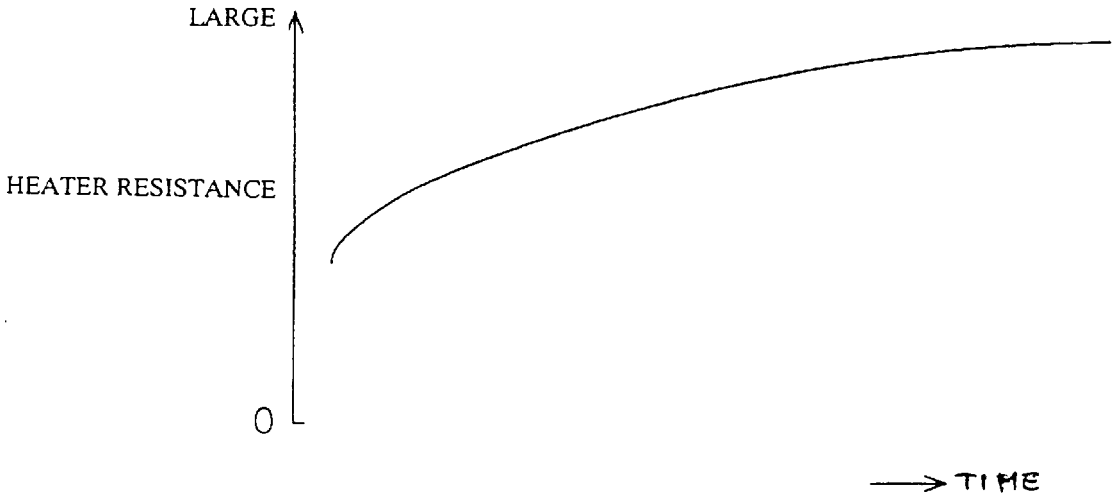
FIG. 10C is a time chart showing the change of heater resistance during the heater power control in accordance with the preferred embodiment of the present invention.

The voltage applied to the heater 67 is fixed to a predetermined reference voltage (e.g., 13 V). The heater power is controlled based on a control base value being set according to a predetermined duty ratio. FIG. 10A is a time chart showing a heater power profile used in the heater power control of this embodiment. FIG. 10B is a time chart showing the change of heater current during the heater power control. FIG. 10C is a time chart showing the change of heater resistance during the heater power control.

The heater temperature and the heater resistance increase with elapsing time. Accordingly, the heater current and the heater power gradually decrease.

In FIG. 10A, a line P1 represents a power profile corresponding to the duty ratio of 100% (i.e., full power supply mode). In other words, when the full power supply (duty ratio=100%) is required in the heater power control, the electric power is supplied to heater 67 according to the power profile P1. This effectively prevents the electric power from being excessively supplied to the heater 67 and eliminates the cracking of sensing element or heater body. Another line P2 represents an additional power profile corresponding to the duty ratio of 80%. In other words, when the power supply of duty ratio=80% is required in the heater power control, the electric power is supplied to heater 67 according to the power profile P2.

Figure 7:
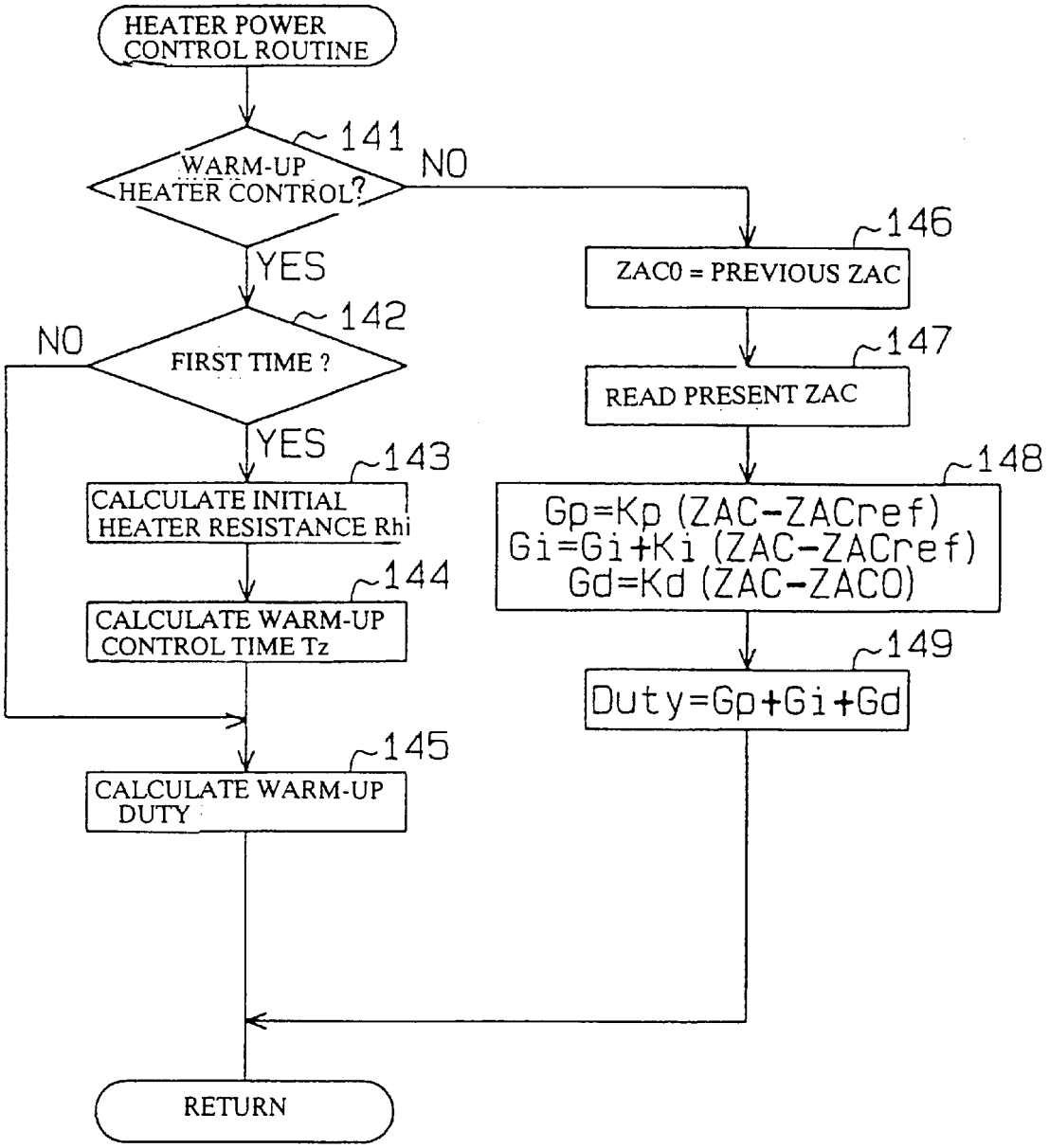
FIG. 7 is a flowchart showing a heater power control routine used in the microcomputer in accordance with the preferred embodiment of the present invention.

FIG. 7 is a flowchart showing details of the heater power control of step 140 shown in FIG. 5.

In step 141, it is checked whether the conditions for implementing the warm-up heater control are satisfied.

For example, the conditions for implementing the warm-up heater control are as follow:

the element impedance ZAC is equal to or larger than a predetermined threshold (e.g., 50Ω); and a later-described warm-up control time Tz has not elapsed yet.

In practice, immediately after the engine startup operation or during the engine warm-up operation, the element impedance ZAC is large and accordingly the warm-up heater control is necessary. Thus, the judgement result of step 141 becomes YES.

When the judgement result is YES in step 141, the control flow proceeds to step 142 and succeeding steps 143 to 145 to perform the warm-up heater control. This embodiment performs the warm-up heater control based on the full power supply mode (duty ratio=100%). In this case, the duty ratio 'Duty' is appropriately adjusted in such a manner that actual heater power changes according to the power profile P1 (i.e., target heater power) shown in FIG. 10A.

More specifically, in step 142, it is checked whether or not the warm-up heater control is performed for the first time. When the judgement is YES in step 142, the control flow proceeds to step 143 to read the heater voltage Vh and the heater current Ih and then calculate an initial heater resistance Rhi (=Vh/Ih). Next, in step 144, a warm-up control time Tz is calculated according to a characteristic line shown in FIG. 11A. The warm-up control time Tz designate a period of time required for continuing the warn-up heater control. According to the characteristic line shown in FIG. 11A, the warm-up control time Tz becomes short with decreasing initial heater resistance Rhi (i.e., becomes short with decreasing temperature of heater 67 or sensing element 50). In other words, the warm-up control time Tz becomes long with increasing initial heater resistance Rhi (i.e., becomes long with decreasing temperature of heater 67 or sensing element 50).

Figure 11A:
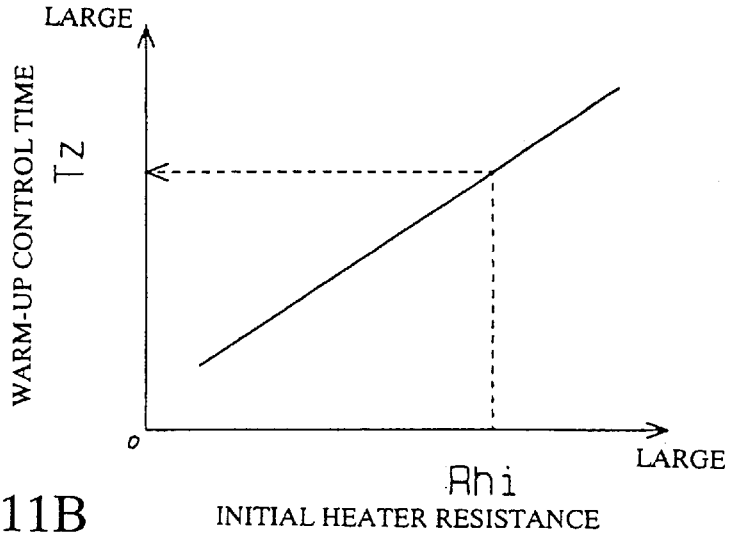
FIG. 11A is a graph explaining a setting of warm-up control time in accordance with the preferred embodiment of the present invention.
Figure 11B:
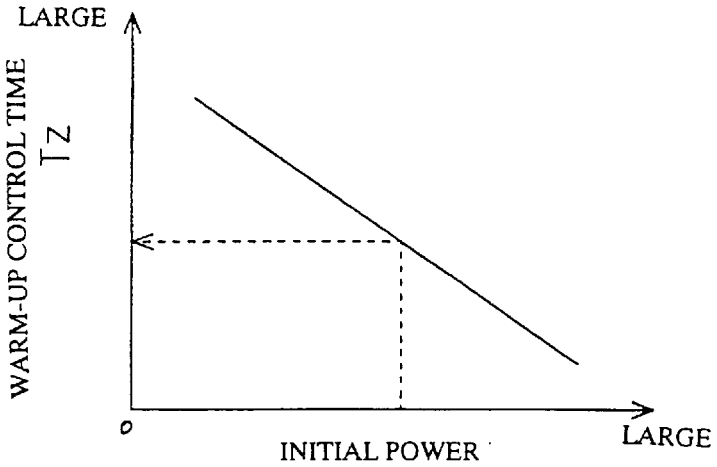
FIG. 11B is a graph explaining another setting of warm-up control time in accordance with the preferred embodiment of the present invention.
Figure 11C:
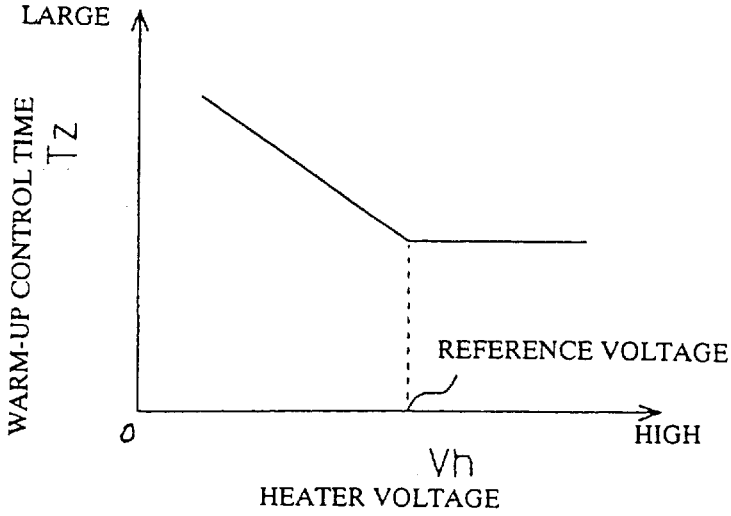
FIG. 11C is a graph explaining another setting of warm-up control time in accordance with the preferred embodiment of the present invention.

Instead of using the characteristic line shown in FIG. 11A, it is possible to calculate the warm-up control time Tz according to a characteristic line shown in FIG. 11B or FIG. 11C. When the characteristic line shown in FIG. 11B is used, the step 143 is modified in such a manner that an initial power of heater 67 is calculated based on the heater voltage Vh and the heater current Ih. And, the warm-up control time Tz corresponding to the calculated initial power is obtained with reference to the characteristic line shown in FIG. 11B. Meanwhile, when the characteristic line shown in FIG. 11C is used, the step 143 is modified in such a manner that the warm-up control time Tz corresponding to the heater voltage Vh is obtained with reference to the characteristic line shown in FIG. 11C.

Although the heater power control routine shown in FIG. 7 performs the setting of warm-up control time Tz only when the warm-up heater control is performed for the first time. It is also possible to repetitively perform the setting of warm-up control time Tz according to any one of characteristic lines shown in FIGS. 11A to 11C.

Furthermore, an abscissa of FIG. 11C can be replaced by the battery voltage.

Next, in step 145, a warm-up duty is calculated. The warm-up duty is a control duty ratio being set for the heater power control. In this case, as a control base value, the duty ratio is set to 100%. A momentary heater power is calculated based on the heater voltage Vh and the heater current Ih and is compared with a target heater power being set according to the power profile P1. Through a correction based on a ratio of the target heater power to the momentary heater power, the warm-up duty is calculated.

Figure 12A:
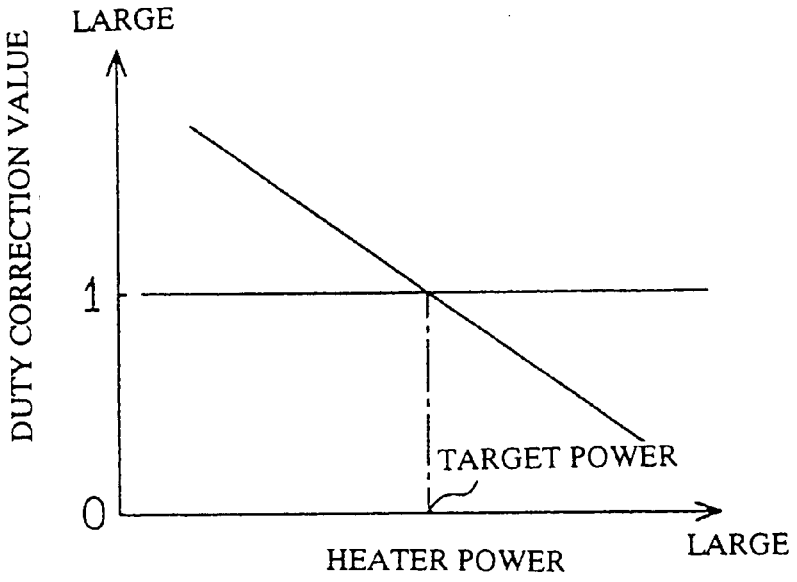
FIG. 12A is a graph explaining a setting of duty correction value in accordance with the preferred embodiment of the present invention.

More specifically, a duty correction value is set with reference to the characteristic line shown in FIG. 12A so as to eliminate a deviation of actual heater power from the target value. Then, the obtained duty correction value is multiplied with the control base value (duty=100%) to finally determine the warm-up duty. According to this correction, the duty ratio becomes smaller when the momentary heater power exceeds the target heater power. After finishing the calculation of the warm-up duty, the control flow returns to the main routine shown in FIG. 5. The heater controller 26 supplies the electric power to the heater 67 based on the warm-up duty determined through the above-described heater power control routine shown in FIG. 7.

According to the step 145 of FIG. 7, the deviation of heater power from the target value is momentarily obtained and the control base value (duty=100%) is corrected so as to eliminate the deviation of heater power from the target value. Thus, the electric power supplied to the heater 67 is always equalized to the target value on the power profile P1.

For example, in the step 145 of FIG. 7, the warm-up duty can be calculated according to the following equation.

warm-up duty={target heater power/momentary heater power (i.e., calculated value)}×100%

In this case, the deviation of heater power from the target value is momentarily obtained and the control base value (duty=100%) is corrected so as to eliminate the deviation of heater power from the target value. Thus, the electric power supplied to the heater 67 is always equalized to the target value on the power profile P1.

Figure 12B:
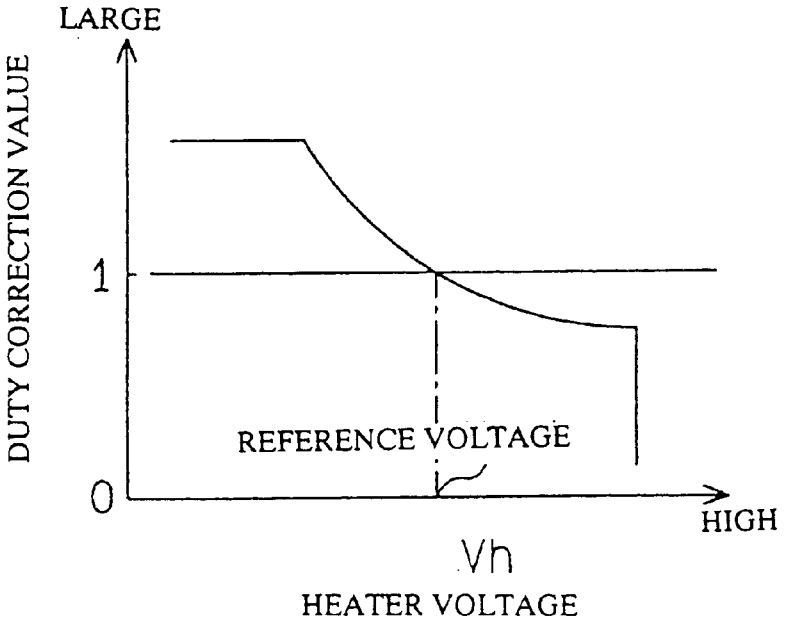
FIG. 12B is a graph explaining another setting of duty correction value in accordance with the preferred embodiment of the present invention.

As apparent from the foregoing explanation, the correction is performed to equalize the momentary (i.e., actual) heater power to the target value. However, the correction of this embodiment can be modified in such a manner that the momentary heater voltage Vh is equalized to a reference heater voltage. More specifically, the warm-up duty correction value is set with reference to the characteristic line shown in FIG. 12B so as to eliminate a deviation of momentary heater voltage Vh from the reference heater voltage. Then, the obtained duty correction value is multiplied with the control base value (duty=100%) to determine the warm-up duty.

Alternatively, it is possible to determine the warm-up duty according to the following equation.

warm-up duty={reference heater voltage/momentary heater voltage (i.e., detected value)}×100%

In these cases, the deviation of heater power from the target value can be reduced. Thus, the electric power supplied to the heater 67 is always equalized to the target value on the power profile P1. An abscissa of FIG. 12B can be replaced by the battery voltage.

On the other hand, when the judgement is NO in step 141, the control flow proceeds to steps 146 to 149 to perform an ordinary heater control operation based on a sensing element resistance or based on a heater resistance.

More specifically, in step 146, an element impedance ZAC in the previous processing is set as a previous value ZAC0. Then, the control flow proceeds to step 147 to read the momentary element impedance ZAC (i.e., a detection value in the routine shown in FIG. 6).

Then, the control flow proceeds to step 148 to calculate a proportional term Gp, an integral term Gi, and a derivative term Gd according to the following equations.

$$Gp=Kp\cdot(ZAC-ZACref)$$

$$Gi=Gi+Ki\cdot(ZAC-ZACref)$$

$$Gd=Kd\cdot(ZAC-ZAC0)$$

wherein Kp represents a proportional constant, Ki represents an integral constant, Kd represents a derivative constant, and ZACref represents a reference impedance.

Finally, the control flow proceeds to step 149 to calculate the control duty ratio by summing the proportional term Gp, the integral term Gi, and the derivative term Gd (i.e., Duty=Gp+Gi+Gd). After finishing the calculation of control duty ratio, the control flow returns to the main routine shown in FIG. 5.

Figure 13:
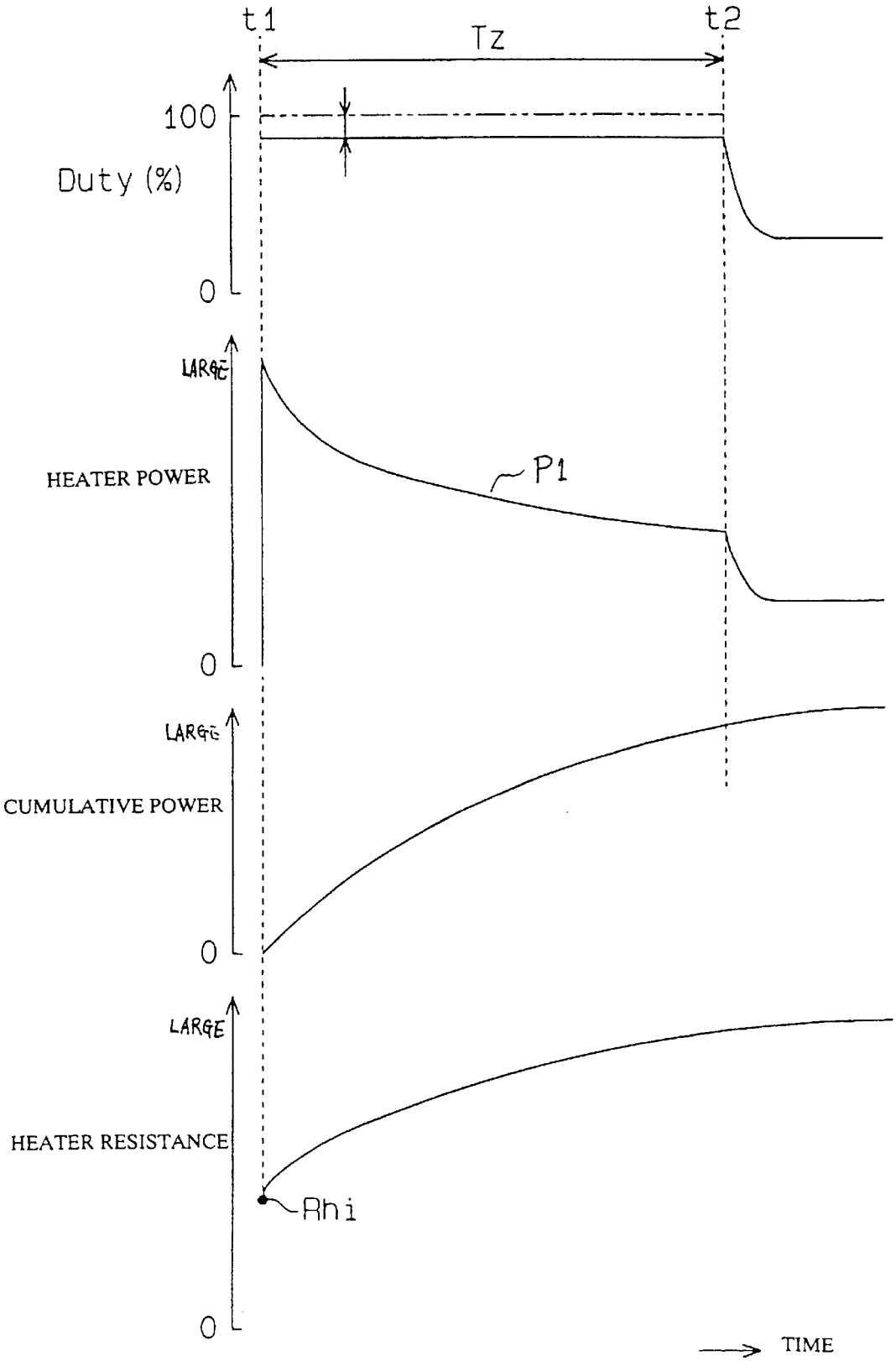
FIG. 13 is a time chart showing the change of duty, heater power, cumulative power, and heater resistance during the warm-up operation in accordance with the preferred embodiment of the present invention.

FIG. 13 is a time chart explaining the heater power control operation of this embodiment.

At timing t1, the warm-up control time Tz is set according to the initial heater resistance Rhi. The warm-up heater control is performed during a limited period of time Tz from time t1 to t2 (i.e., t2−t1=Tz) according to the full power supply mode (duty ratio=100%). In this case, if the momentary heater power deviates from the target heater power on the power profile P1, the control duty is corrected to eliminate this deviation. FIG. 13 shows the change of cumulative power as well as the change of heater resistance. After the time has passed 't2', the feedback control of element impedance ZAC begins.

The above-described embodiment brings the following effects.

The warm-up heater control (e.g., full power control) is performed based on the power profile determined under the condition that the control base value is set to the duty ratio=100% while the reference voltage is applied to the heater 67. This heater control prevents electric power from being excessively supplied to the heater 67. Thus, it becomes possible to prevent the sensing element or the heater body from being cracked due to excessive power supply to the heater. Accordingly, this embodiment provides adequate warm-up characteristics for the A/F sensor 30 and eliminates the cracking of sensing element or heater body.

In this case, it is preferable that the reference heater voltage (e.g., 13V) is smaller than an ordinary value (e.g., 14V). The reference heater voltage serves as a criteria for setting the power profile. Setting such a lower heater voltage can secure a large margin of time in case of the sensing element or heater body reaching the cracking.

Especially, when the A/F sensor 30 has a multilayered structure, the solid electrolytic element 51 is positioned close to the heater 67. In this respect, the multilayered sensor is sensitive to the problem of element cracking or heater cracking. The above-described embodiment of this invention can solve this problem.

The present invention is not limited to the above-described embodiment and therefore can be modified in the following manner.

The step 145 of FIG. 7 can be modified so as to perform a feedback control of heater power. First, a proportional term, an integral term, and a derivative term are obtained in addition to a deviation ΔQ of momentary heater power (calculated value) from the target heater power on the power profile P1. Then, the warm-up duty is calculated according to the following equation.

$$\text{warm-up duty}=Kp\cdot\Delta Q+\Sigma Ki\cdot\Delta Q+Kd\ (\text{present}\ \Delta Q-\text{previous}\ \Delta Q)$$

The power profile P1 shown in FIG. 10A can be converted into map data and stored in a memory of microcomputer 20. The warm-up heater control operation can be performed based on the elapse of time from the start of control with reference to the map data. The cumulative power increases monotonously during the heater power control. Thus, the elapse of time can be replaced by the cumulative power.

When the heater voltage or the heater current decreases, the cumulative power increases slowly. In other words, the relationship between the cumulative power and the elapse of time may deviate from an expected relationship. In such a case, the target power is corrected so as to eliminate this deviation.

Figure 14A:
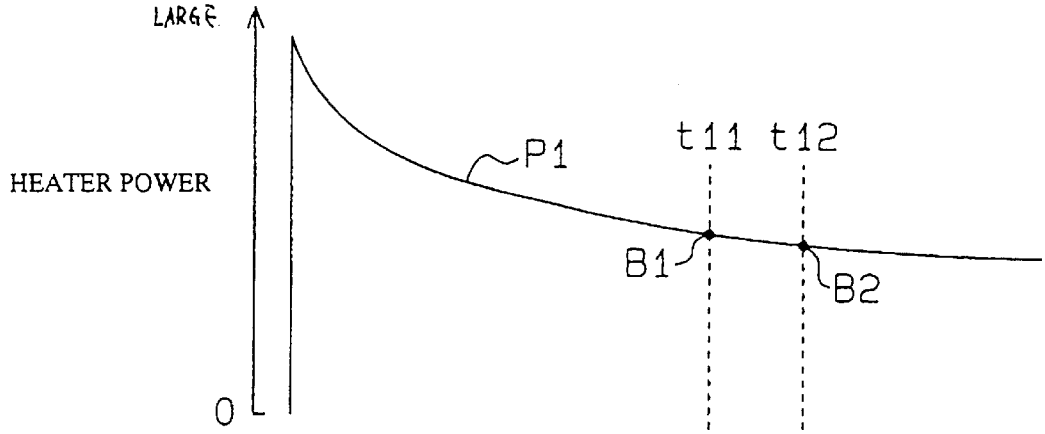
FIG. 14A is a time chart showing the change of heater power during the warm-up operation in accordance with the preferred embodiment of the present invention.
Figure 14B:
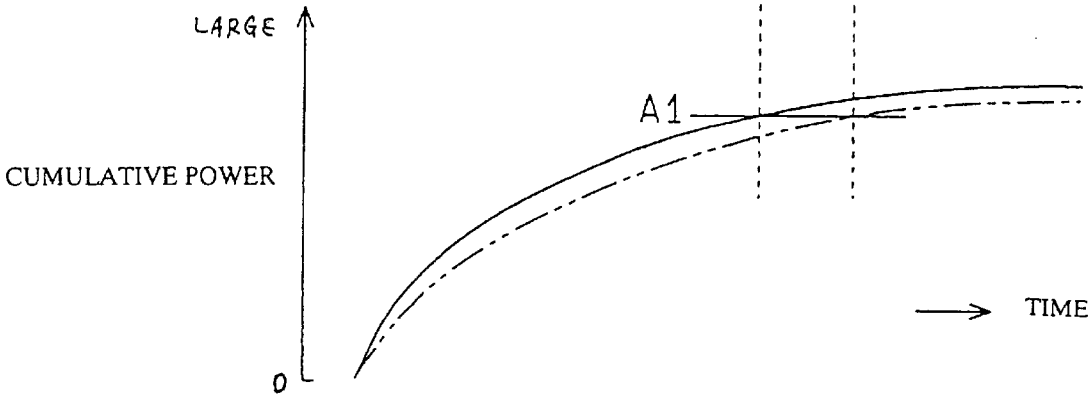
FIG. 14B is a time chart showing the change of cumulative power during the warm-up operation in accordance with the preferred embodiment of the present invention.

More specifically, in an ordinary case, the cumulative power increases according to a solid line shown in FIG. 14B. The target power is determined according to the power profile P1. However, if the increase of cumulative power is delayed (refer to an alternate long and two short dashes line shown in FIG. 14B), the timing of cumulative power reaching the point A1 is delayed from time t11 to time t12. In this case, to speedily warm up the sensing element, it is necessary to increase the heater power. Thus, the heater control is performed after time t11 based on the map data (target power B1 of power profile P1). More specifically, the target power at time t12 is changed from B2 to B1. According to this correction, it becomes possible to assure smooth and prompt warm-up performance of A/F sensor 30.

Furthermore, when the heater voltage or the heater current decreases, it is also preferable to correct the target power so as to eliminate the deviation of heater power from the target power.

Furthermore, it is preferable that the duty ratio for the heater power supply is controlled so as to prevent the heater power from exceeding (i.e., so as to become equal to or smaller than) a value on the power profile P1. This is the substantial setting of a guard value according to the power profile P1 applied to the heater power. In this case, it becomes possible to suppress the electric power from being excessively supplied to the heater.

Besides the usage of power profile P1 (duty ratio=100%), additional power profile P2 (duty ratio=80%) can be used to perform the warm-up heater control. In this case, the control base value is set to the duty ratio=80%. The electric power is supplied to the heater 67 according to the power profile P2.

Furthermore, it is possible to selectively change the duty ratio during the heater power control operation. For example, the duty ratio can be changed from 100% (i.e., power profile P1) to 80% (i.e., power profile P2) or vice versa during the warm-up heater control operation. Adopting such switching of duty ratio is effective to reduce the thermal shock applied to the sensing element when the element temperature is low.

Meanwhile, it is preferable that the voltage drop at a wire harness portion is taken into consideration in the setting of power profile. The wire harness is usually necessary to connect the A/F sensor and a control device (i.e., air-fuel detecting apparatus). More specifically, to compensate the voltage drop at the wire harness portion, the power profile shifts toward an increased side. Alternatively, correcting the warm-up duty is preferable to compensate the voltage drop at the wire harness portion.

It is also preferable to correct the guard value for the heater power so as to eliminate a deviation of momentary voltage from the reference voltage. It is also preferable to correct the guard value considering the voltage drop at the wire harness portion.

Furthermore, it is preferable to use a 'current profile' shown in FIG. 10B instead of using the power profile. The characteristic line shown in FIG. 10B defines or expresses an ideal transitional change of heater current during the heater power control operation performed under the condition that the duty ratio is set to 100% and the reference voltage is applied to the heater 67. According to the current profile shown in FIG. 10B, the heater current gradually decreases with elapsing time. In the warm-up heater control, the electric power is supplied to the heater 67 according to this current profile. More specifically, when the control base value is set to a predetermined duty ratio (e.g., 100%), the correction is performed based on a ratio of the target heater current according to the current profile to the momentary heater current.

The warm-up duty is calculated according to the following equation.

$$\text{warm-up duty}=\{\text{target heater current}/\text{momentary heater current (detected value)}\}\times 100\%$$

In this case, the deviation of heater current from the target value is momentarily obtained and the control base value (duty=100%) is corrected so as to eliminate the deviation of heater current from the target value. Thus, the electric power supplied to the heater 67 is always equalized to the target value of the current profile shown in FIG. 10B.

The current profile shown in FIG. 10B can be converted into map data and stored in a memory of microcomputer 20. The map data can be read from this memory occasionally after the control has started.

Furthermore, during the warm-up heater control operation, it is preferable to perform a feedback control of heater power by adopting a PID technique so as to eliminate a deviation of momentary heater current from the target heater current. Furthermore, it is preferable to limit the heater power supply amount (or control duty) so as to prevent the heater current from exceeding (i.e., so as to become equal to or smaller than) a value on the current profile.

Furthermore, in determining the power profile or the current profile, it is not always necessary to apply a stationary reference voltage to the heater. If the voltage applied to the heater (i.e., reference heater voltage) fluctuates, the change of heater power or heater current will follow up the change of heater resistance. Accordingly, it is possible to determine the power profile or the current profile so as not to cause cracking of sensing element or heater body. The power profile or the current profile should be determined under the condition that the heater power supply amount (or control duty) is set to a predetermined control base value.

The heater power control of this invention can be applied to various gas concentration sensors capable of detecting the concentration of any one of O2, NOx, HC, CO or other gas components contained in the exhaust gas or any other sample gas to be measured. The number of sensor cells is not limited to a specific value. Usage of the gas concentration detecting apparatus of this embodiment is not limited to an air-fuel ratio detection and therefore can be applied to various purposes.

What is claimed is:

1. A heater control apparatus for a gas concentration sensor, comprising a sensing element including a solid electrolytic substrate and a heater for heating and activating said sensing element, said heater control apparatus comprising:

a warm-up heater control means for controlling electric power supplied to said heater based on a control base value being set according to a predetermined duty ratio, when said sensing element is warmed up to an active temperature, wherein a power profile is determined beforehand to set a target heater power, and said warm-up heater control means controls the electric power supplied to said heater so as to equalize an actual heater power to said target heater power determined according to said power profile.

2. The heater control apparatus for a gas concentration sensor in accordance with claim 1, wherein said warm-up heater control means performs a correction applied to said control base value based on a relationship between a momentary heater power and said target heater power, and controls the electric power supplied to said heater based on a corrected duty ratio.

3. The heater control apparatus for a gas concentration sensor in accordance with claim 1, wherein said warm-up heater control means performs a feedback control operation based on a deviation of momentary heater power from said target heater power.

4. The heater control apparatus for a gas concentration sensor in accordance with claim 1, wherein said power profile is converted into map data, and said warm-up heater control means controls the electric power supplied to said heater based on an elapse of time or a cumulative power with reference to said map data during a heater control operation.

5. The heater control apparatus for a gas concentration sensor in accordance with claim 1, wherein said warm-up heater control means corrects said target heater power so as to eliminate a deviation in a relationship between an elapse of time and a cumulative power or eliminate a deviation in a relationship between said target heater power and a momentary heater power.

6. The heater control apparatus for a gas concentration sensor in accordance with claim 1, wherein said warm-up heater control means limits the electric power supplied to said heater so as to prevent the actual heater power from exceeding said target heater power.

7. The heater control apparatus for a gas concentration sensor in accordance with claim 1, wherein said power profile is determined under a condition that the duty ratio of said control base value is set to 100%.

8. The heater control apparatus for a gas concentration sensor in accordance with claim 1, wherein said power profile is determined under a condition that a stationary reference voltage is applied to said heater.

9. The heater control apparatus for a gas concentration sensor in accordance with claim 1, wherein said power profile is determined under a condition that a stationary reference voltage is applied to said heater, and said warm-up heater control means performs a correction applied to said control base value based on a relationship between a momentary heater voltage and said stationary reference voltage, and controls the electric power supplied to said heater based on a corrected duty ratio.

10. The heater control apparatus for a gas concentration sensor in accordance with claim 9, wherein the correction of said warm-up heater control means is performed according to a ratio of said stationary reference voltage to said momentary heater voltage.

11. The heater control apparatus for a gas concentration sensor in accordance with claim 1, wherein said gas concentration sensor is for detecting the concentration of an exhaust gas component emitted from an engine installed in an automotive vehicle, said heater control apparatus receives electric power supplied from a battery mounted on said automotive vehicle, and said warm-up heater control means sets a guard value corresponding to a voltage change of said battery to limit said duty ratio of said control base value.

12. The heater control apparatus for a gas concentration sensor in accordance with claim 1, wherein said warm-up heater control means calculates an initial resistance value of said heater and sets a warm-up control time corresponding to said initial resistance value, for performing a warm-up heater control operation during a limited period of time defined by said warm-up control time.

13. The heater control apparatus for a gas concentration sensor in accordance with claim 1, wherein said warm-up heater control means enlarges said warm-up control time when an actual voltage applied to said heater is lower than the reference voltage.

14. The heater control apparatus for a gas concentration sensor in accordance with claim 1, wherein said warm-up heater control means performs a warm-up operation during a limited period of time before starting an ordinary heater power control operation based on a sensing element resistance or a heater resistance.

15. The heater control apparatus for a gas concentration sensor in accordance with claim 1, wherein said heater and said solid electrolytic substrate are integrally multilayered.

16. A heater control apparatus for a gas concentration sensor, comprising a sensing element including a solid electrolytic substrate and a heater for heating and activating said sensing element, said heater control apparatus comprising:

a warm-up heater control means for controlling electric power supplied to said heater based on a control base value being set according to a predetermined duty ratio, when said sensing element is warmed up to an active temperature, wherein a current profile is determined beforehand to set a target heater current, and said warm-up heater control means controls the electric power supplied to said heater so as to equalize an actual heater current to said target heater current determined according to said current profile.

* * * * *